US007933537B2

(12) United States Patent
Fowler et al.

(10) Patent No.: US 7,933,537 B2
(45) Date of Patent: Apr. 26, 2011

(54) XEROGRAPHIC CHARGING DEVICE HAVING PLANAR TWO PIN ARRAYS

(75) Inventors: Jeffrey M Fowler, Rochester, NY (US); Gerald F Daloia, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 367 days.

(21) Appl. No.: 12/207,840

(22) Filed: Sep. 10, 2008

(65) Prior Publication Data

US 2010/0061765 A1 Mar. 11, 2010

(51) Int. Cl.
*G03G 15/02* (2006.01)

(52) U.S. Cl. ..... 399/170; 399/173

(58) Field of Classification Search ..... 399/173, 399/170

See application file for complete search history.

(56) References Cited

U.S. PATENT DOCUMENTS

| | | | | |
|---|---|---|---|---|
| 3,691,373 | A | 9/1972 | Comptom et al. | |
| 4,725,732 | A | 2/1988 | Lang et al. | |
| 4,792,680 | A | 12/1988 | Lang et al. | |
| 7,110,701 | B2 * | 9/2006 | Facci et al. | 399/171 |
| 2006/0193657 | A1 * | 8/2006 | Zona et al. | 399/170 |

* cited by examiner

*Primary Examiner* — David M Gray
*Assistant Examiner* — G. M. Hyder
(74) *Attorney, Agent, or Firm* — Lloyd F. Bean II

(57) ABSTRACT

In a xerographic printing apparatus, including a charge receptor, the charge receptor being movable in a process direction; and a charge device for applying a charge to a surface of the charge receptor, the charge device having a corona member including a pin array being oriented and extending substantially non perpendicular to the surface of the charge receptor in the process direction.

8 Claims, 6 Drawing Sheets

XEROGRAPHIC CHARGING DEVICE HAVING PLANAR TWO PIN ARRAYS

TECHNICAL FIELD

The present disclosure relates to a charging device used in electrophotographic printing or xerography.

BACKGROUND

In the well-known process of electrophotographic or xerographic printing, an electrostatic latent image is formed on a charge-retentive imaging surface, typically a "photoreceptor," and then developed with an application of toner particles. The toner particles adhere electrostatically to the suitably-charged portions of the photoreceptor. The toner particles are then transferred, by the application of electric charge, to a print sheet, forming the desired image on the print sheet. An electric charge can also be used to separate or "detack" the print sheet from the photoreceptor.

For the initial charging, transfer, or detack of an imaging surface, the most typical device for applying a predetermined charge to the imaging surface is a "corotron," of which there are any number of variants, such as the scorotron or dicorotron. Common to most types of corotron is a bare conductor, in proximity to the imaging surface, which is electrically biased and thereby supplies ions for charging the imaging surface. The conductor typically comprises one or more corona members, such as wires (often called a "corona wire") or a metal bar forming saw-teeth (a "pin array"), the conductor extending parallel to the imaging surface and along a direction perpendicular to a direction of motion of the imaging surface. Other structures, such as a screen, conductive shield and/or nonconductive housing, are typically present in a charging device, and some of these may be electrically biased as well. A corotron having a screen or grid disposed between the conductor and the photoreceptor is typically known as a "scorotron".

In one type of charging device of particular interest with respect to the present invention, a charging electrode may be provided in the form of an electrically conductive strip having projections, scalloped portions, or teeth members integrally formed with, and extending from, a longitudinal edge of the electrode. This arrangement, known as a pin array electrode, provides significant structural and operational advantages over other types of electrode devices such as thin wire electrodes, including comparatively high structural strength, greater charge uniformity and reduced levels of undesirable ozone emissions. In this respect, U.S. Pat. No. 3,691,373 to Compton et al. demonstrates a corona generating device generally comprising a pin array electrode supported on either side by support strips, and mounted within an electrically nonconductive base member. One of the side strips is adapted for connection to an exterior connector from a high voltage source. The electrode is fixed into position within the base member by a plurality of transverse pins which fit through matching holes in the base member, the pin array, and the support strips. The corona generating device disclosed therein may further include a screen and/or an auxiliary electrode as well as various additional conductive shields for regulating charging current to control uniformity of charge. A detailed description and illustration of pin array corona generating devices, specifically describing the mounting mechanism used to support a pin array electrode in a corotron device is provided in U.S. Pat. Nos. 4,725,732 and 4,792,680, the entire contents of which are hereby incorporated by reference herein.

Several problems have historically been associated with the unique design of pin array corona generating devices. Generally, it is important that the pin array electrode, which is typically stretched between mountings at opposite ends of the corona generating device, is maintained under tension so as to be in a taut condition. Any looseness and/or kinks in the electrode member may result in a non-uniform charge derived from the corona generating device. In order to insure that the electrode member is sufficiently supported, the pin array electrode is conventionally mounted between support members, as shown in previously referenced U.S. Pat. Nos. 4,725,732 and 4,792,680.

It is also desirable, in corona generating devices, to provide an arrangement for easily replacing faulty or a deteriorated corona generating electrode upon failure, or preferably, for replacing a corona generating electrode prior to failure through preventative maintenance. Typically, the replacement of a pin array electrode necessitates replacement of the entire assembly of the corona generating device, creating waste and additional expense. Since replacement is usually handled by a service technician at the commercial site at which the machine is located, ease of replacement and adjustment in a minimum amount of time is essential. Thus, it is an object of the present invention to provide a pin array corona generating device that is cost effective and serviceable while eliminating waste by permitting the replacement and adjustment of the corona generating electrode within a corona generating device.

SUMMARY

There is provided a xerographic printing apparatus, including a charge receptor, the charge receptor being movable in a process direction; and a charge device for applying a charge to a surface of the charge receptor, the charge device having a corona member including a pin array being oriented and extending substantially non-perpendicular to the surface of the charge receptor in the process direction.

DETAILED DESCRIPTION

Figure 1:
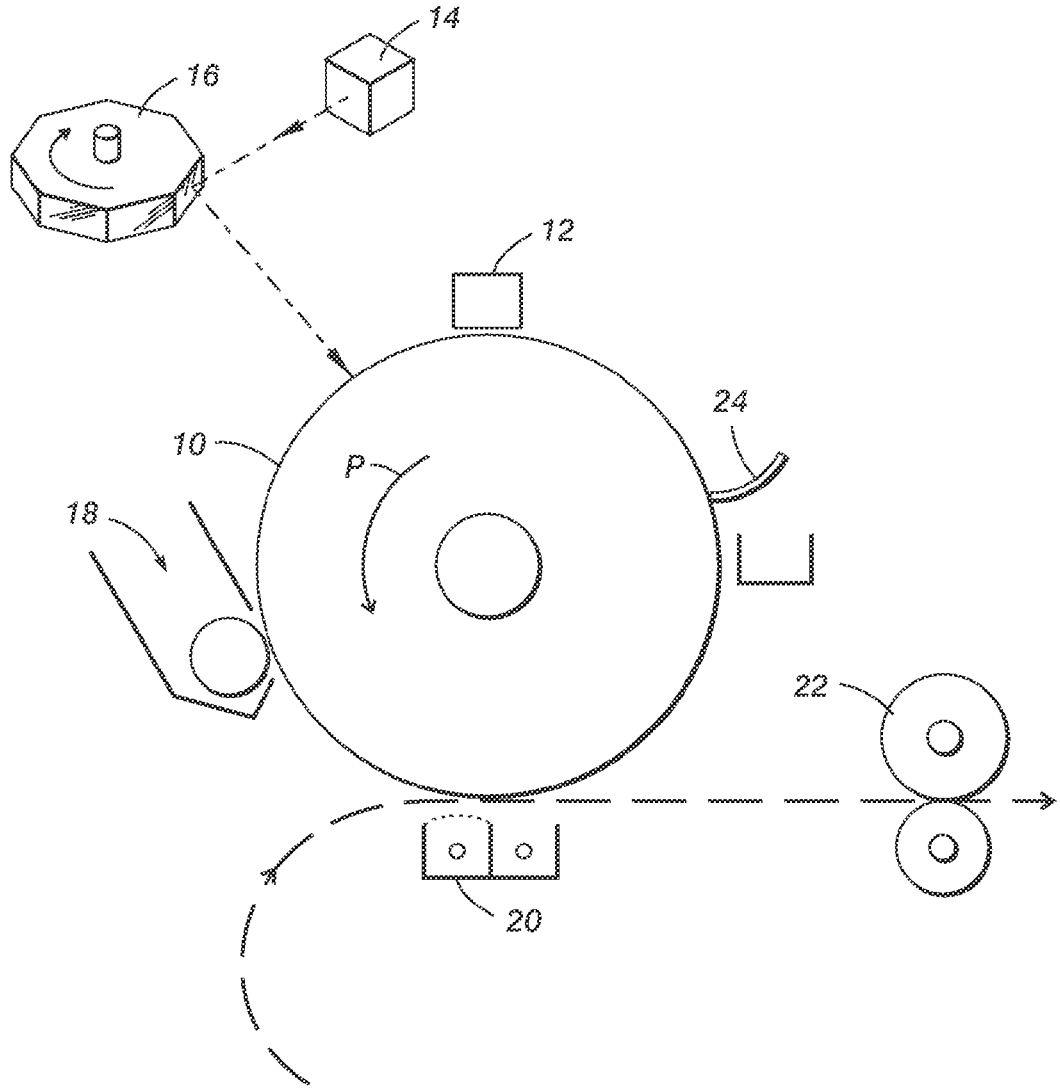
FIG. 1 is an elevational view showing elements of a electrophotographic or xerographic printer.
Figure 2:
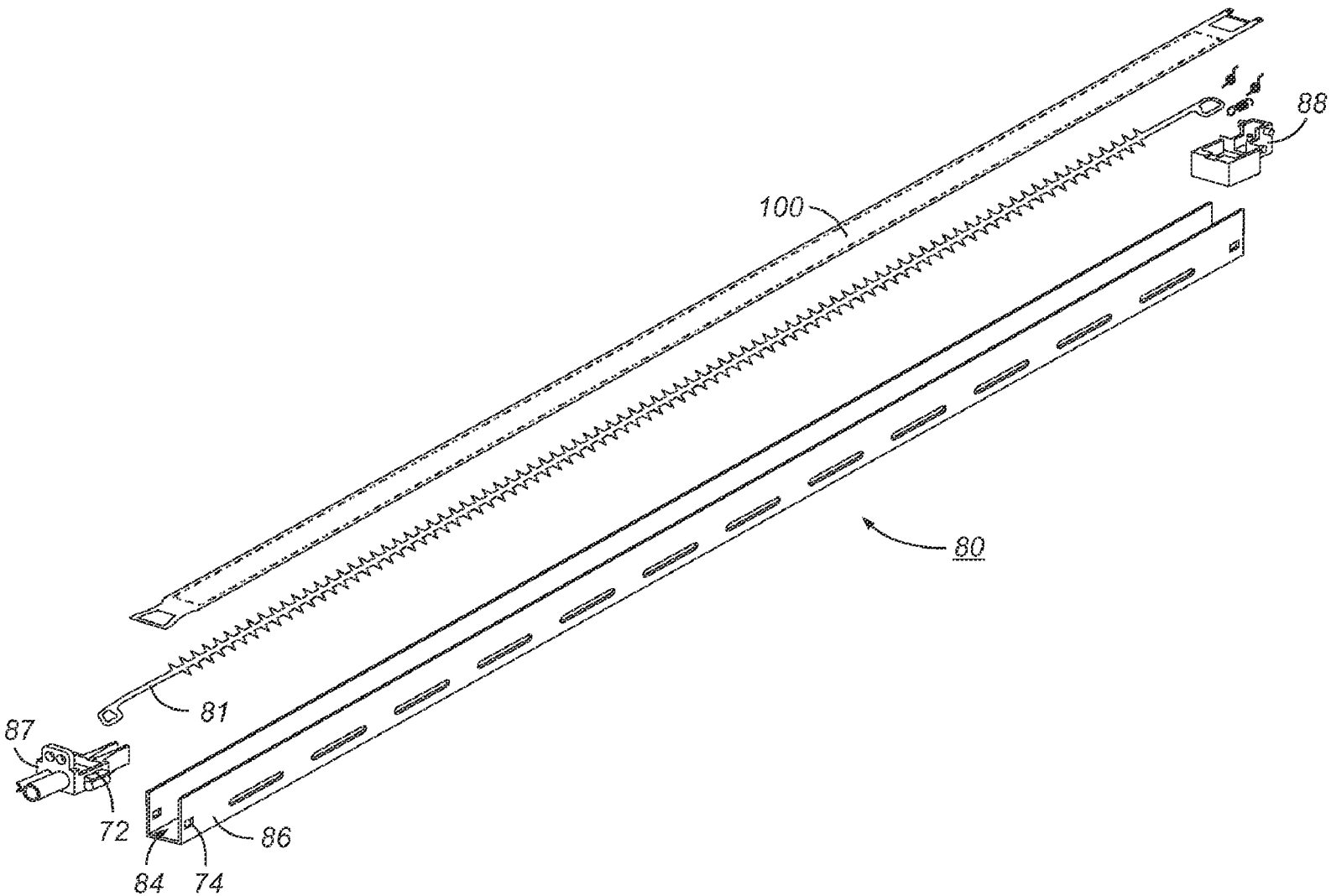
FIG. 2 is a perspective view of one embodiment of a two-array scorotron.

FIG. 1 is an elevational view showing elements of a electrophotographic or xerographic printer, such as a copier or a "laser printer". There is provided in the printer a charge receptor such as photoreceptor 10, which may be in the form of a belt or drum, and which defines a charge-retentive surface for forming electrostatic images thereon. The photoreceptor 10 is caused to rotate through process direction P.

The first step in the process is the general charging of the relevant photoreceptor surface. This initial charging is performed by a charge device indicated as 12, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises a laser source 14 and a rotatable mirror 16 which act together, in a manner known in the art, to discharge certain areas of the surface of photoreceptor 10 according to a desired image to be printed. Although the figure shows a laser source 14 to selectively discharge the charge-retentive surface, other apparatus that can be used for this purpose include an LED bar, or, in a copier, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10.

After certain areas of the photoreceptor 10 are discharged by the laser source 14, the remaining charged areas are developed by a developer unit such as 18, causing a supply of dry toner to contact or otherwise approach the surface of photoreceptor 10. The developed image is then advanced, by the motion of photoreceptor 10, to a transfer station 20, which causes the toner adhering to the photoreceptor 10 to be electrically transferred to a print sheet, which is typically a sheet of plain paper, to form the image thereon. The sheet of plain paper, with the toner image thereon, is then passed through a fuser 22, which causes the toner to melt, or fuse, into the sheet of paper to create the permanent image. Any residual toner remaining on the photoreceptor 10 can be removed by cleaning blade 24 or equivalent device.

Although a monochrome xerographic print engine is shown in FIG. 1, the above-described elements would be apparent in a color engine, whether such an engine included a single photoreceptor with multiple exposure and development devices, or multiple photoreceptors each transferring toner images onto a common intermediate transfer belt; the present disclosure is applicable to such color devices as well.

Moving now to FIGS. 2-6, there is shown an embodiment for a pin array corona generating device of the present disclosure used in an electrophotographic reproducing apparatus of the type described hereinabove, for example as the charging device located at charging station. It will be understood that the corona generating device of the present invention may also be used in a transfer, detack or cleaning subsystem since such subsystems may also utilize a corona generating device.

Each end mounting block 87, 88 is fixedly supported at opposite ends of the shield member 84 via cooperative engagement of mounting tabs 72, situated on either side of the mounting blocks, and fixed mounting support apertures 74, situated adjacent the opposed ends of shield member 84, on the side shield members 86 thereof. A screen member 100. is included of the type generally known in the art and utilized in a specific type of corona generating device known as a "scorotron". In normal operation, the screen member 100 is disposed along the edges of side shield members so as to be interposed between the electrode 81 and the surface to be charged (not shown). A mounting assembly 102 may also be provided to facilitate mounting and removal of screen 100 thereon.

Figure 4:
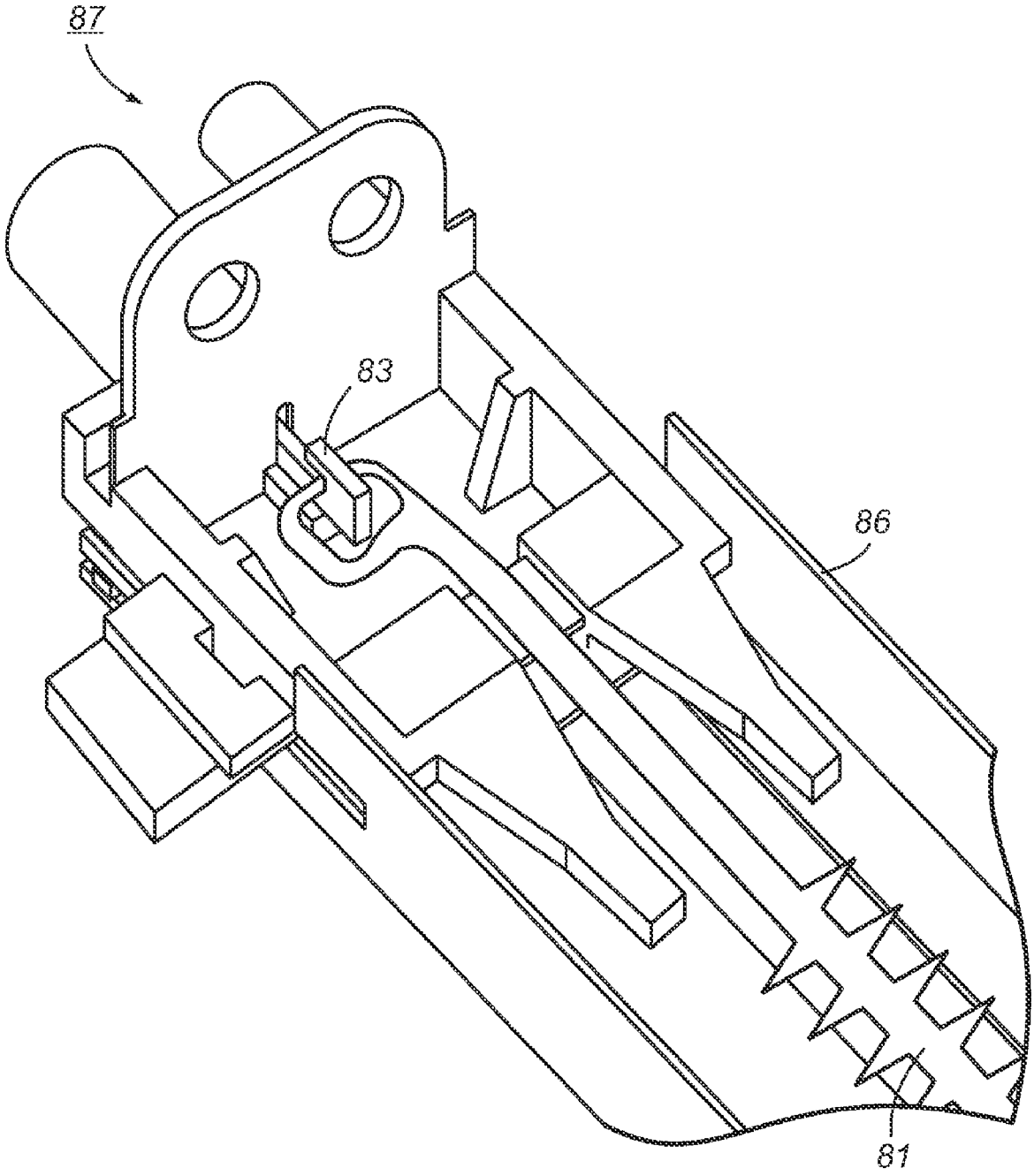
FIG. 4 is a perspective view of one embodiment of one end of the two-array scorotron.
Figure 5:
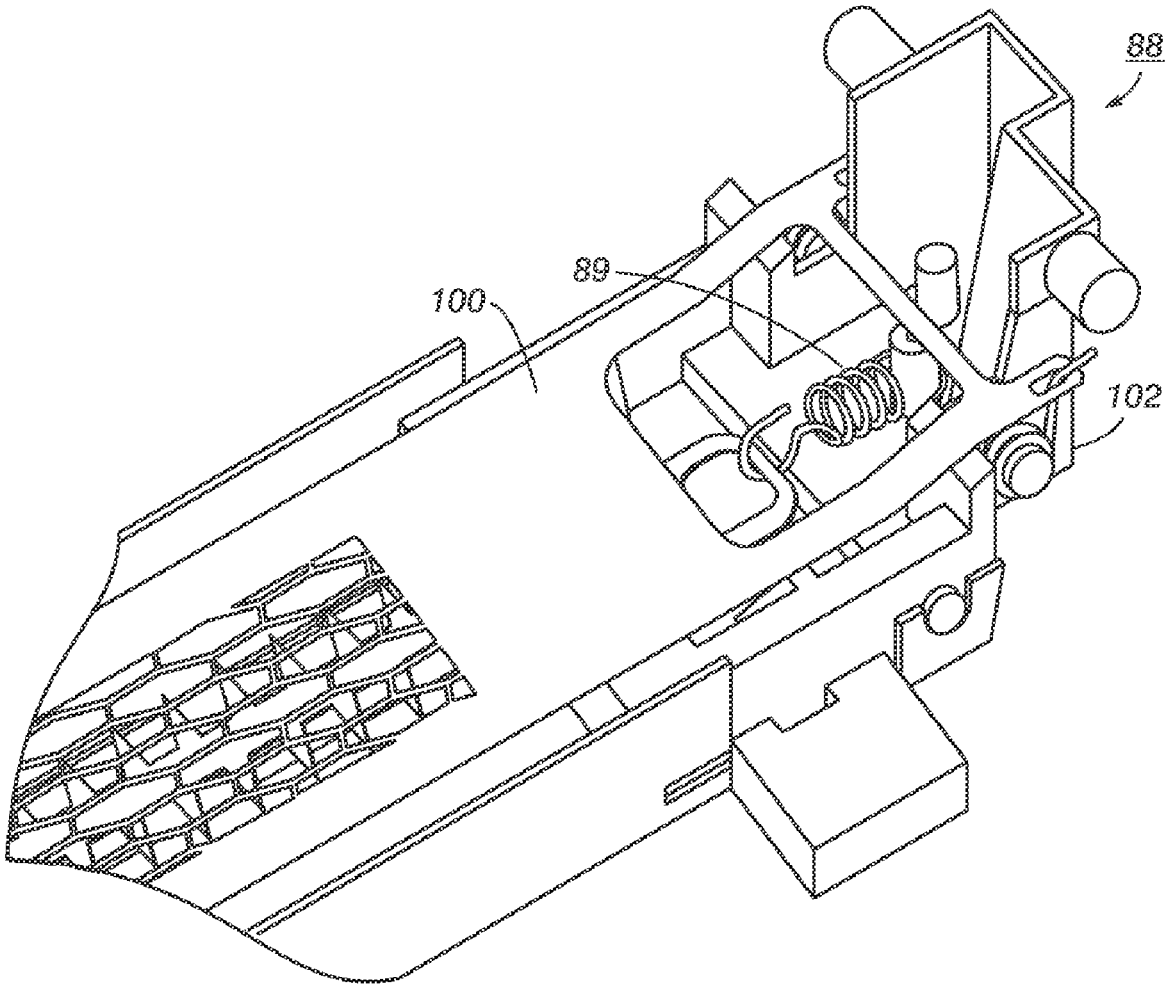
FIG. 5 is a perspective view of one embodiment of the other end of the two-array scorotron.

One end mounting block of the corona charging device 80, for example end mounting block 88, includes a tension support mounting in accordance with the present invention, comprising an extension spring 89 and a mounting assembly as shown in FIG. 5. End mounting block 87, situated opposite the tension support mounting disposed in mounting block 87 operates to support the electrode 81 in a fixed mounting position in any manner known in the art, such as hook member 83 as shown in FIG. 4. It will be understood, however, that it is contemplated that corona generating device 80 may include a pair of tension support mountings positioned at opposite ends of the corona generating device such that each end mounting block 87 and 88 may include an extension spring 89 and mounting systems therefore to provide the present tension support mounting for the corona generating electrode.

Figure 3:
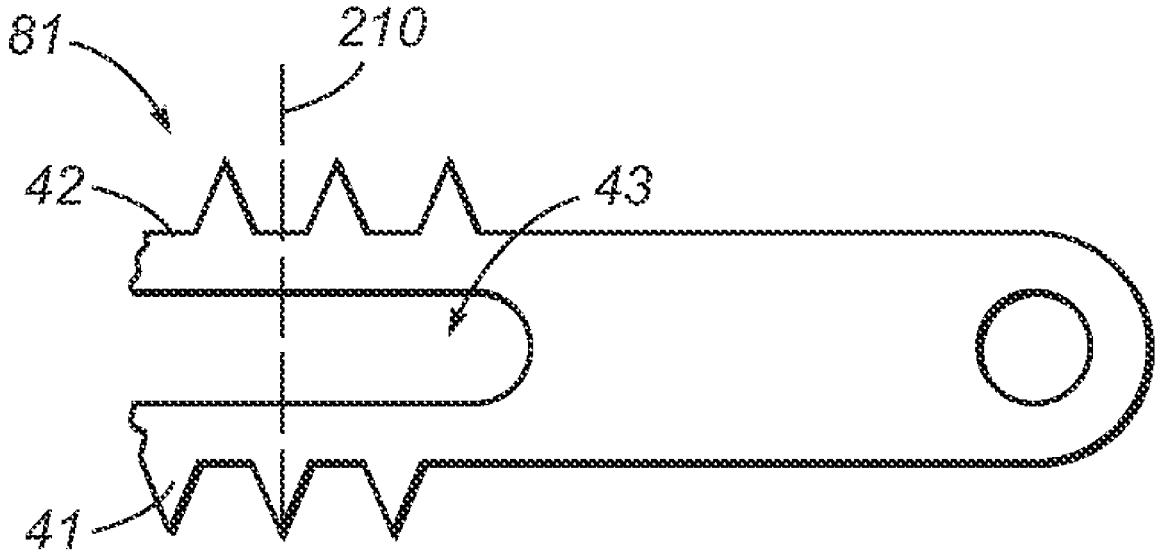
FIG. 3 is an enlarged view of one embodiment of a two-array pin electrode.

As illustrated in FIG. 3, pin array electrode 81 preferably comprises a thin, elongate member fabricated from a highly conductive material having an array of integral projections such as pins including triangular teeth or scalloped edges along both edges 41 and 42 thereof and extending along the entire length of both edges of the elongate electrode member so as to extend in a direction substantially parallel to a surface to be charged (not shown).

Applicants have found that pin arrays oriented parallel to the surface of the photoreceptor, allow for a lower-profile charge device. If desired a slot 43 may run the length of the etched part through which the plastic spine may protrude to form a barrier interposed between pin array 41 and pin array 42 so as to physically separate the coronas generated from each array. This unified dual pin array may be made symmetrical, further simplifying assembly. The resulting charge device has performance similar to a conventional dual pin array corotron, but has lower part cost and assembly cost because it uses fewer parts. Further, the lower profile it allows provides greater flexibility in the layout of higher-level printing systems.

Pin array electrode 81 may be coupled to a high-voltage extension member 83, or may be provided with an integral high voltage extension member for permitting electrical connection of the pin electrode 81 to a high-voltage power source (not shown). The pin array electrode 81 has a length approximately equal to the width of the surface to be charged, and a height sufficient to expose the teeth thereof which is required to provide proper charging characteristics. In a preferred embodiment, the pin array electrode 81 has a thickness of approximately 0.08 mm (0.03 inches) and the teeth of pin array extends approximately 3.5 mm (0.136 inches) from both edges and has a pin tip-to-pin tip interval of approximately 3 mm (0.12 inches). It is also desirable to have the pins on one edge pin array offset from the other so that pin is aligned with a valley of the other pin array as illustrated in FIG. 3 by dotted line 210.

Figure 6:
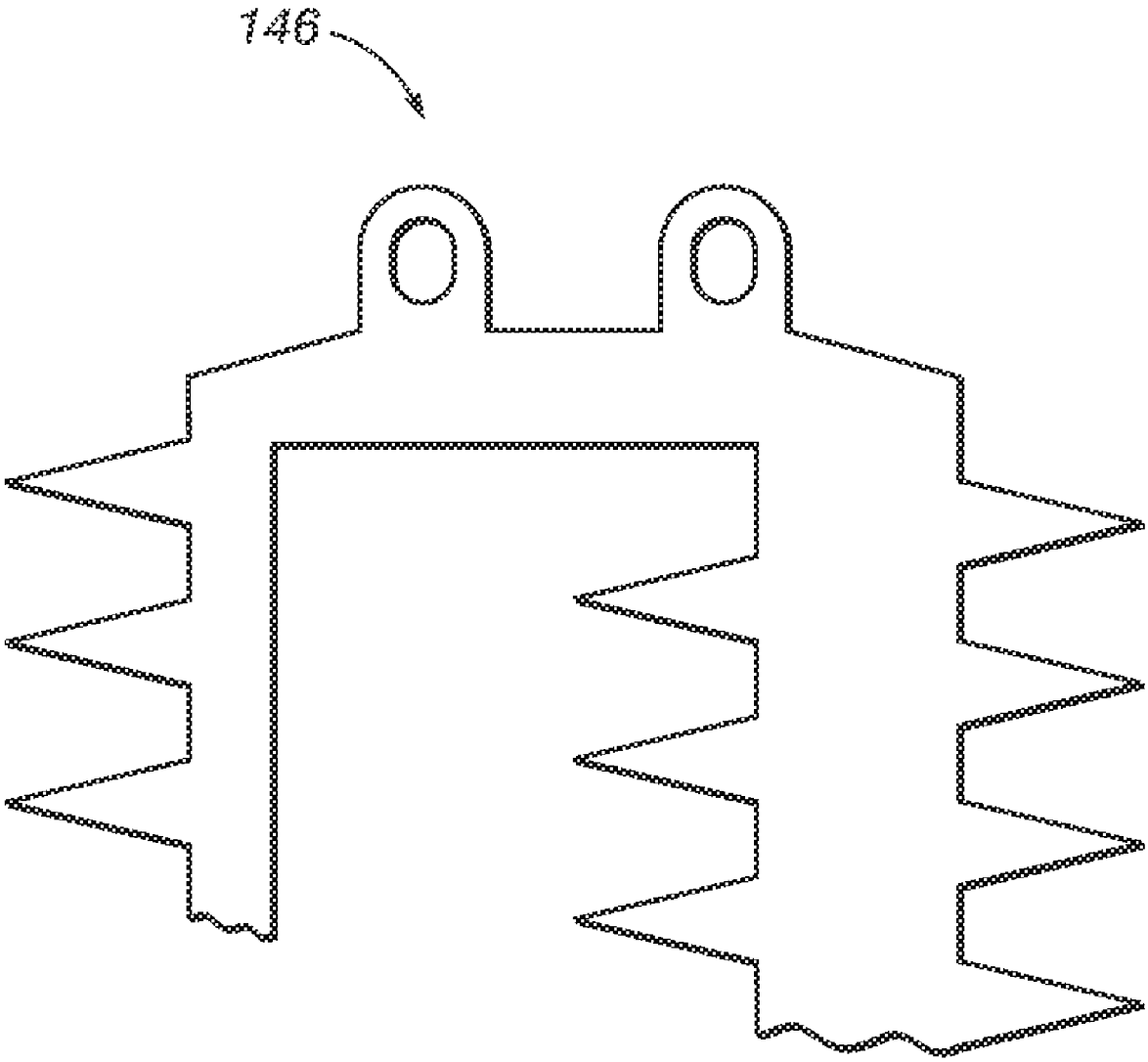
FIG. 6 is a perspective view another embodiment of a two-array scorotron.

FIG. 6 illustrates another embodiment of the present disclosure includes electrode array having three or more pin arrays 146 positioned parallel to the surface.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An electrophotographic printing apparatus, comprising:

a charge receptor, the charge receptor being movable in a process direction; and a charge device for applying a charge to a surface of the charge receptor, the charge device having a corona member including, a pin array arranged in a plane oriented substantially parallel to said surface of the charge receptor.

2. The apparatus of claim 1, wherein said corona member further comprising a second pin array arranged in a plane oriented substantially parallel to said surface of the charge receptor.

3. The apparatus of claim 2, wherein said first mentioned pin array is immediately adjacent to said second pin array.

4. The apparatus of claim 2, wherein said first mentioned pin array and said second pin array are formed from the same substrate.

5. The apparatus of claim 2, wherein said first mentioned pin array and said second pin array have an insulator interposed therebetween.

6. The apparatus of claim 2, wherein said first mentioned pin array and said second pin array have substantially the same pin to pin spacing.

7. The apparatus of claim 2, wherein said first mentioned pin array and said second pin array are offset.

8. The apparatus of claim 2, wherein said corona member further comprises one or more additional pin arrays.

* * * * *